United States Patent [19]

Vinczer

[11] 4,062,089

[45] Dec. 13, 1977

[54] CLASP MECHANISM

[76] Inventor: Peter Vinczer, Room 706, 30 Bloor St. W., Toronto, Ontario, Canada, M4W 1A2

[21] Appl. No.: 723,569

[22] Filed: Sept. 15, 1976

[30] Foreign Application Priority Data

Sept. 22, 1975 Canada ..... 236047

[51] Int. Cl.[2] ..... A44B 3/04

[52] U.S. Cl. ..... 24/97; 24/212

[58] Field of Search ..... 24/97, 212; 85/3-5

[56] References Cited

U.S. PATENT DOCUMENTS

| | | | |
|---|---|---|---|
| 155,612 | 10/1874 | Hard | 24/97 |
| 250,891 | 12/1881 | Cutting | 24/97 |
| 2,501,151 | 3/1950 | Bayardi | 24/97 |
| 2,516,732 | 7/1950 | Taegtstroem | 24/97 |

FOREIGN PATENT DOCUMENTS

| | | | |
|---|---|---|---|
| 1,529,650 | 5/1968 | France | 24/97 |
| 894 of | 1905 | United Kingdom | 24/97 |

*Primary Examiner*—Bernard A. Gelak

*Attorney, Agent, or Firm*—Zarley, McKee, Thomte, Voorhees & Sease

[57] ABSTRACT

A cufflink clasp mechanism in which a medallion has a perpendicular tubular shaft at the end of which is a bar pivotally mounted by a pin passing through the shaft and an upright member attached to said bar; said upright member having a spherical enlarged portion approximately the size of the internal diameter of the tubular shaft and having a flat side parallel to and remote from said bar and flat side substantially perpendicular to said bar to which the flat side of a block is urged by a spring to bias the bar to stay in a position either parallel to the shaft or perpendicular to the shaft as it is set.

4 Claims, 3 Drawing Figures

CLASP MECHANISM

This invention relates to improvements in the design of a clasp mechanism such as might be used in cuff links.

Since most cuff links require a shaft to pass through button holes in a garment, they must be designed with a holding mechanism which will easily pass through the button holes to insert the cufflink but will not let the link drop out once in place. This is commonly achieved by providing the end of the shaft (opposite the decorative portion or medallion) with an elongated bar (or crossbar) which is commonly pivotally mounted so that it can be aligned parallel to the shaft for insertion and then pivoted perpendicular to the shaft to hold the cuff link in place.

It is the purpose of this invention to provide a cuff link with a mechanism whereby the bar will pivot for the purposes aforesaid and will additionally be urged to maintain a parallel or perpendicular position, in which ever it is placed.

It is a further purpose of this invention to provide a mechanism of this nature which is relatively easy to manufacture and assemble.

These and other objects are sought to be achieved by the present invention which comprises a hollow tubular shaft member extending perpendicularily from the back of the medallion of the cuff link, and oblong bar having a flat upstanding member attached to the end of the tubular shaft member by a pin which passes through opposite sides of of the shaft and the upstanding member; the upstanding member extending into the interior of the tubular shaft. Additionally the upstanding member is provided with an enlarged spherical portion slightly smaller in diameter than the internal diameter of the shaft. The bar is urged into it's parallel or perpendicular position by having flat sides parallel and opposite as well as perpendicular and adjacent the bar to which a block resting inside the tubular member is pressed by a spring compressed between the medallion and the block within the tubular member.

The invention can be better understood by the following description of one embodiment with reference to the accompanying drawings in which.

Figure 1:
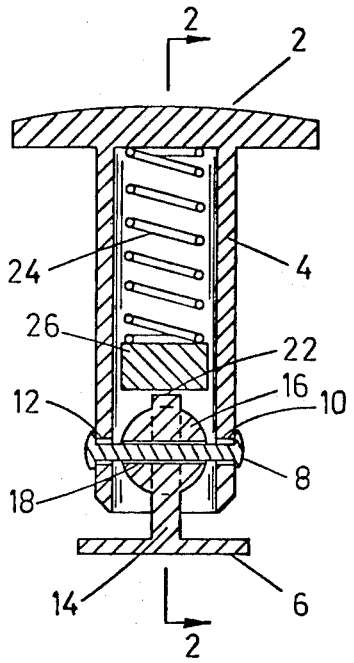
FIG. 1 is a vertical cross section through a cuff link with a clasp in accordance with this invention.
Figure 2:
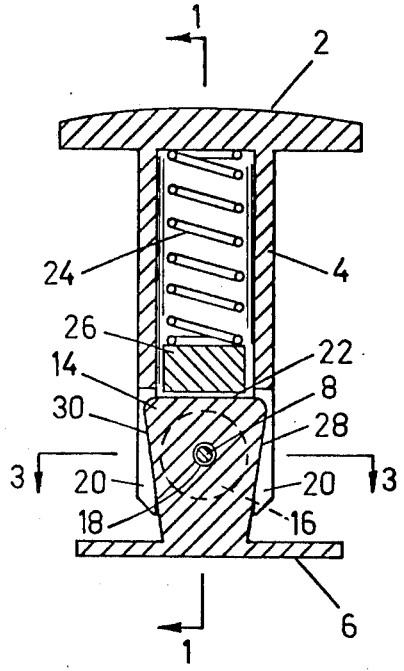
FIG. 2 is a vertical cross section of the same cufflink viewed in a direction perpendicular to that of FIG. 1.
Figure 3:
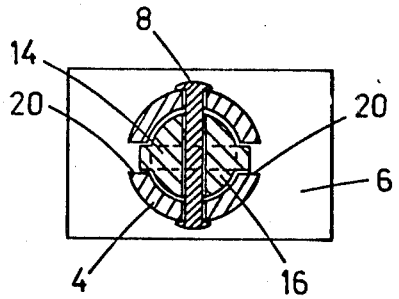
FIG. 3 is a horizontal cross section through line 3—3 in FIG. 2.

As can be seen in FIG. 1 and FIG. 2, the cuff link illustrated has a decorative portion or medallion 2 from which there extends perpendicularily a shaft 4 which is hollow and cylinderically tubular (although other shapes could be used with appropriate design modification).

At the end of the shaft 4, an elongated bar 6 is pivotally attached to the shaft by a pin 8 which passes through diametrically opposite holes 10 and 12 in the wall of the tubular shaft. As best seen in FIG. 2, the bar 6 has flat upstanding member 14 which extends into the interior of the shaft and through which the pin 8 passes thereby providing the pivotal mounting of the bar 6 to the shaft 4.

The upstanding flat member 14 has super-imposed, more or less in the center thereof, an enlarged spherical portion 16 the diameter of which is slightly less than the internal diameter of the shaft 4. A hole 18 bored through this enlarged part of the upstanding member allows the pin to pass through.

As can be seen in FIG. 2, the flat member illustrated is larger than the internal diameter of the shaft 4 and is accomodated by slots extending longitudinally from the end of the shaft on opposite sides of the shaft wall, mutually aligned with the member 14 and perpendicular to the axis of the pin 8. This not only allows the insertion of the flat upstanding member to assemble the clasp but also allows the bar 6 and the flat upstanding member to pivot about the pin 8. These slots are seen at 20 in the accompanying drawings, aligned with the plaine of movement of the member 14.

The upstanding member 14 is provided with a flat side 22 parallel to and opposite or remote from the bar 6. A spring 24 contained within the hollow shaft is compressed so as to urge the flat side of a block 26 against the surface 22 of the upstanding member tending thereby to hold the bar of the clasp in the position illustrated in FIG. 2.

However the side walls 28 and 30 respectively of the upstanding member are also relatively flat, although in the illustrated embodiment they taper upwardly and outwardly. Thus when the bar 6 is pivoted about the axis of the pin 8 so that it is substantially aligned parallel to the shaft 4, the block 26 will be pressed by the spring 24 against either of the flat sides 28 or 30 thereby tending to hold the bar in that position. The tapering of the sides 28 and 30 tend to maintain a bias by which one end or the other of the bar 6 will be pressed against the adjacent wall portion of the shaft 4 and the inventor has found that this is inclined to entrap or catch part of the cloth surrounding the button hole and make it even more difficult to fall out while it is being worn.

The inventor has found that the bar 6, the upstanding member 14 and its enlarged spherical portion 16 may be cast as a single piece of metal and the hole 18 drilled therethrough. The clasp may then be assembled by inserting the spring 24, the block 26, placing the upstanding member of the bar 6 in the end of the shaft aligned with the slots and inserting the pin 8, the ends of which can be hammered or rivited as shown in FIG. 1. The spherical portion 16 being a close tolerance to the internal diameter of the shaft will prevent the wall of the shaft (on either sides of the slots 20) from being caved in by the riviting of the pin 8. However its spherical shape will not interfere with the pivoting of the clasp bar.

Because the assembly may be done in this way, there is no need to spread and close the side walls of the shaft 4, as is required in a mechanism in which the pivotal bar is retained by lugs which project outwards from the portion inside the shaft, a proceedure which requires careful time consuming manual work.

Thus the present invention provides a clasp which is not only useful as part of a cufflink but also has advantages in ease of manufacture and assembly.

The foregoing description represents an illustrative embodiment of the invention from which modifications and variations might be adapted without departing from the inventive concept herein.

What I claim as new and desire to protect by Letters Patent of the United States is:

1. A cufflink comprising a medallion;

a cylindrical hollow tubular shaft extending from the back of said medallion;

a bar pivotally mounted on the end of said shaft by mounting means comprising a member upstanding from said bar adapted to extend into the interior of said shaft and having a flat surface thereon remote from and parallel to said bar;

a spherical portion superimposed on said upstanding member of diameter slightly less than the internal diameter of said hollow tubular shaft;

a pin adapted to extend through the side walls of said tubular shaft and through the center of said spherical portion of said upstanding member thereby pivotally mounting said bar to said shaft.

2. A cufflink as claimed in claim 1 including bias means comprising a block mounted within said tubular shaft and spring means mounted within said shaft to urge said block against said upstanding member.

3. A cufflink as claimed in claim 2 in which said tubular shaft has slots in the side wall thereof in alignment with said flat upstanding member in that portion where the displacement of said upstanding member exceeds the internal dimensions of said tubular shaft.

4. A cufflink as claimed in claim 3 in which the side walls of said upstanding member diverge and extend from said bar at an angle slightly less than 90° thereto.

* * * * *